United States Patent [19]

Miller, Jr. et al.

[11] 4,072,281

[45] Feb. 7, 1978

[54] OPTICAL ATTITUDE REFERENCE

[75] Inventors: Walter E. Miller, Jr., Huntsville; Robert L. Sitton, Tuscumbia; Anthony D. Blackmon, Huntsville, all of Ala.

[73] Assignee: The United States of America as represented by the Secretary of the Army, Washington, D.C.

[21] Appl. No.: 754,204

[22] Filed: Dec. 27, 1976

[51] Int. Cl.[2] ..... F42B 15/02

[52] U.S. Cl. ..... 244/3.16; 250/255

[58] Field of Search ..... 244/3.16, 171, 176, 244/190; 250/203 R, 225; 318/585, 640; 356/148

[56] References Cited

U.S. PATENT DOCUMENTS

| | | | |
|---|---|---|---|
| 3,284,632 | 11/1966 | Niblack | 250/225 |
| 3,778,163 | 12/1973 | Forward | 244/171 |
| 3,820,742 | 6/1974 | Watkins | 244/3.16 |
| 3,981,587 | 9/1976 | Gievers | 250/225 |

*Primary Examiner*—Trygve M. Blix
*Assistant Examiner*—Reinhard J. Eisenzopf
*Attorney, Agent, or Firm*—Nathan Edelberg; Robert P. Gibson; Freddie M. Bush

[57] ABSTRACT

The optical attitude reference system provides missile attitude reference using an optical beam in lieu of conventional gyroscopes. In the missile control systems autopilot, the system uses the properties of polarized light to determine missile roll angle relative to the beam transmitter reference axes at the launch site.

7 Claims, 11 Drawing Figures

OPTICAL ATTITUDE REFERENCE

DEDICATORY CLAUSE

The invention described herein may be manufactured, used, and licensed by or for the Government for governmental purposes without payment to us of any royalty thereon.

BACKGROUND OF THE INVENTION

Several existing missile systems use full three-axis autopilots in their guidance implementation. Even most low cost systems utilize inner loop stabilization or roll axis gyroscopes on board the missile. Advantages of deleting these gyroscopes from missile borne equipment include the obvious cost advantage and also include removal of the acceleration limitation imposed on the missile to preclude gyro damage or malfunction during high "G" launch.

SUMMARY OF THE INVENTION

The optical attitude reference system provides a method for obtaining missile roll angle, either on board the missile, or at the launch station if desired, using a polarized optical beam. This same beam may also provide pitch and yaw missile body references using conventional tracking methods, in addition to information that may be transmitted over the beam by conventional modulation techniques.

DESCRIPTION OF THE PREFERRED EMBODIMENT

Figure 1:
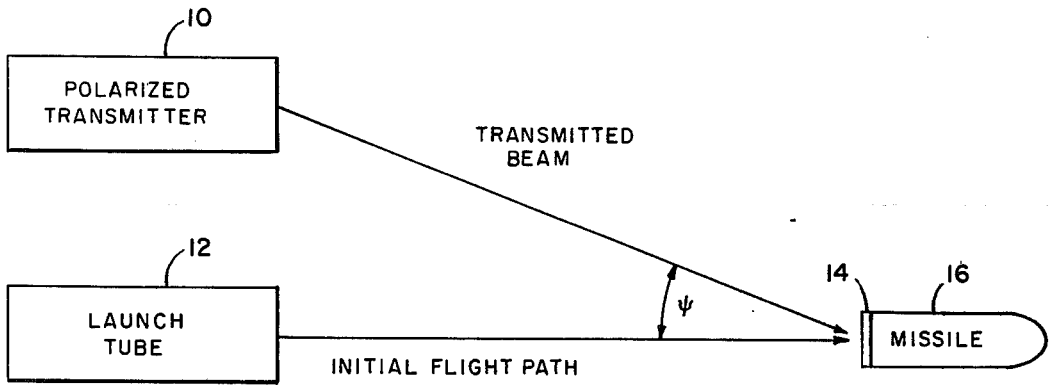
FIG. 1 is a block diagram showing the transmitter relative position to the missile launch site.

Referring now to the drawings wherein like numerals represent like parts in the several figures, FIG. 1 is a block diagram showing typical launch geometry of the missile, with a transmitter 10 being separated a known distance from the missile launch tube 12 or launch site. Transmitter 10 directs a beam of optical energy toward the optical attitude reference system 14 on missile 16. The angle $\psi$ between the initial flight path of the missile and the transmitted beam is predictable due to the known offset of the transmitter. A 180° roll ambiguity of the missile is resolved using this missile body axis angle. The transmitter will always appear to the missile to be at the same relative position with respect to the launch site. Other means of resolving the roll ambiguity are also possible, for example use of a predictable roll profile for a short time after launch, or use of an optical sky/earth sensor.

Figure 2:
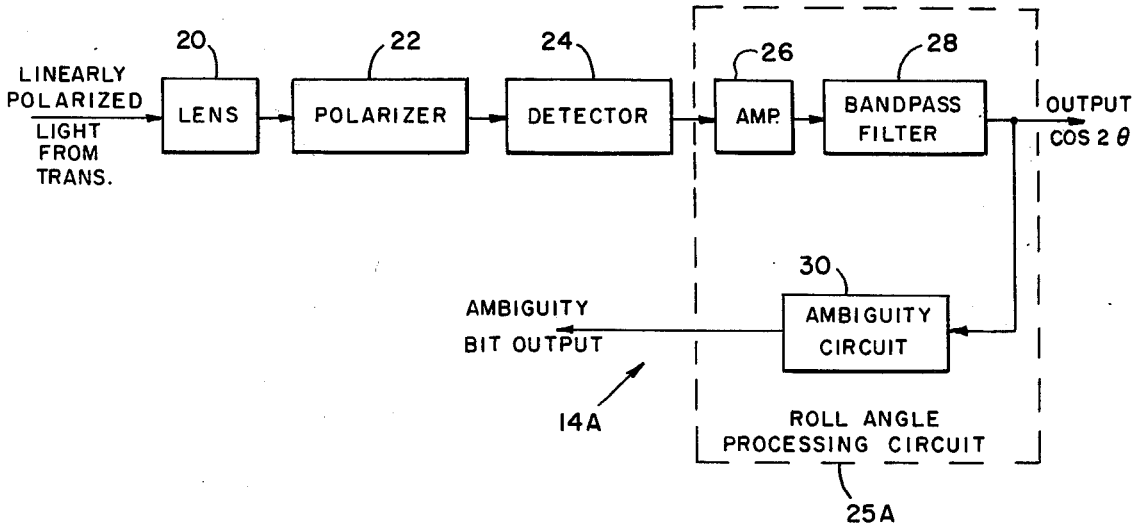
FIG. 2 is a block diagram of a simple embodiment of the missile polarized light detector for a rolling missile.

FIG. 2 discloses a simple embodiment of the attitude reference ambiguity circuit for use with rolling missiles. The optical transmitter (such as a commercial HeNe laser) transmits a linearly polarized beam toward the missile optical attitude reference system 14A. The plane of polarization of the beam (for example vertical) becomes the roll reference of the missile. A lens 20 collects this transmitted optical energy, and directs it through an optical polarizer 22 such as polaroid film. This film could also be the first optical element and be followed by the lens. The polarizer 22 rotates by virtue of the normal missile roll, which modulates the received beam at twice the roll frequency. This frequency doubling occurs because linearly polarized light passing through a polarizer is blocked at 90° and 270° relative angle of the polarizer, and transmitted at 0° and 180°. The output power is $\cos^2 \theta$ times the input power, where $\theta$ is the polarizer rotation angle relative to the input polarization. The polarizer output is coupled to a detector 24. Detector 24 provides a voltage output proportional to the optical power impinging upon it from the lens and polarizer. This voltage is coupled to a roll angle processing circuit 25A wherein it is amplified as necessary by a conventional amplifier 26.

The amplifier 26 output is filtered by conventional filter means 28. If the transmitter was pulsed, high frequency cw modulated, or otherwise modulated as a carrier, the filter 28 could first be designed to recover this carrier. A demodulation circuit would then be incorporated to detect the AM caused by the rotating polarizer, and the output bandpass filtered around the expected roll rates. Where the transmitter is simply a dc source, only the bandpass filter 28 is required as is shown.

Figure 4:
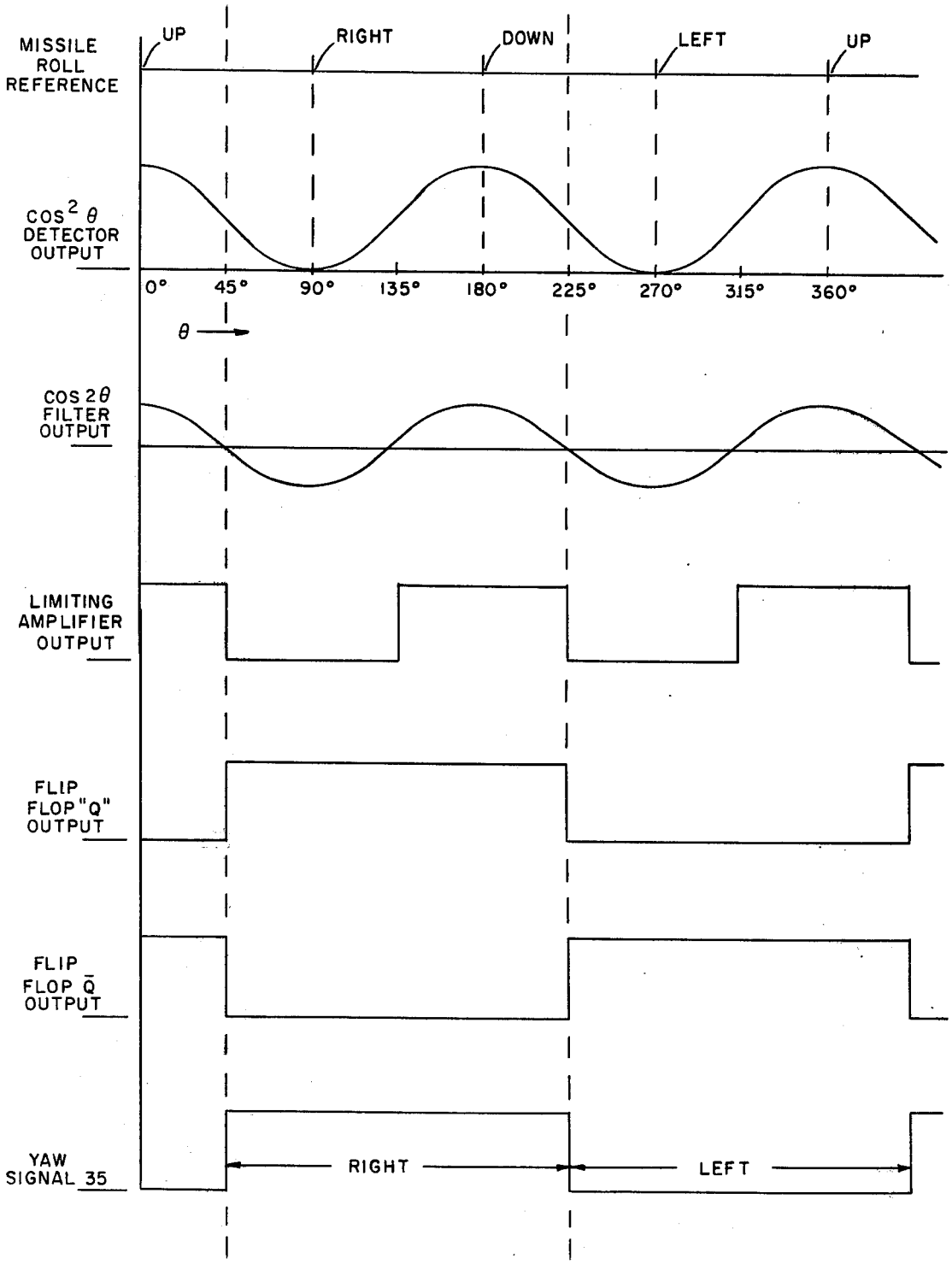
FIG. 4 is a waveshape diagram of the signals present in the circuits of FIGS. 2 and 3.

The output of the bandpass filter is an ac voltage at twice the frequency of the missile roll ($\cos 2\theta$), since $\cos^2 \theta = \frac{1}{2}(1 + \cos 2\theta)$ and the direct current term is rejected by the bandpass filter. The ambiguity caused by the frequency doubling of $\cos^2 \theta$ is shown in the waveforms of FIG. 4; since the output due to "right" ($\theta = 90°$) is the same as that due to "left" ($\theta = 270°$) for the detector and filter outputs, where "right" and "left" refer to roll positions of an arbitrary reference point on the rolling missile.

Figure 3:
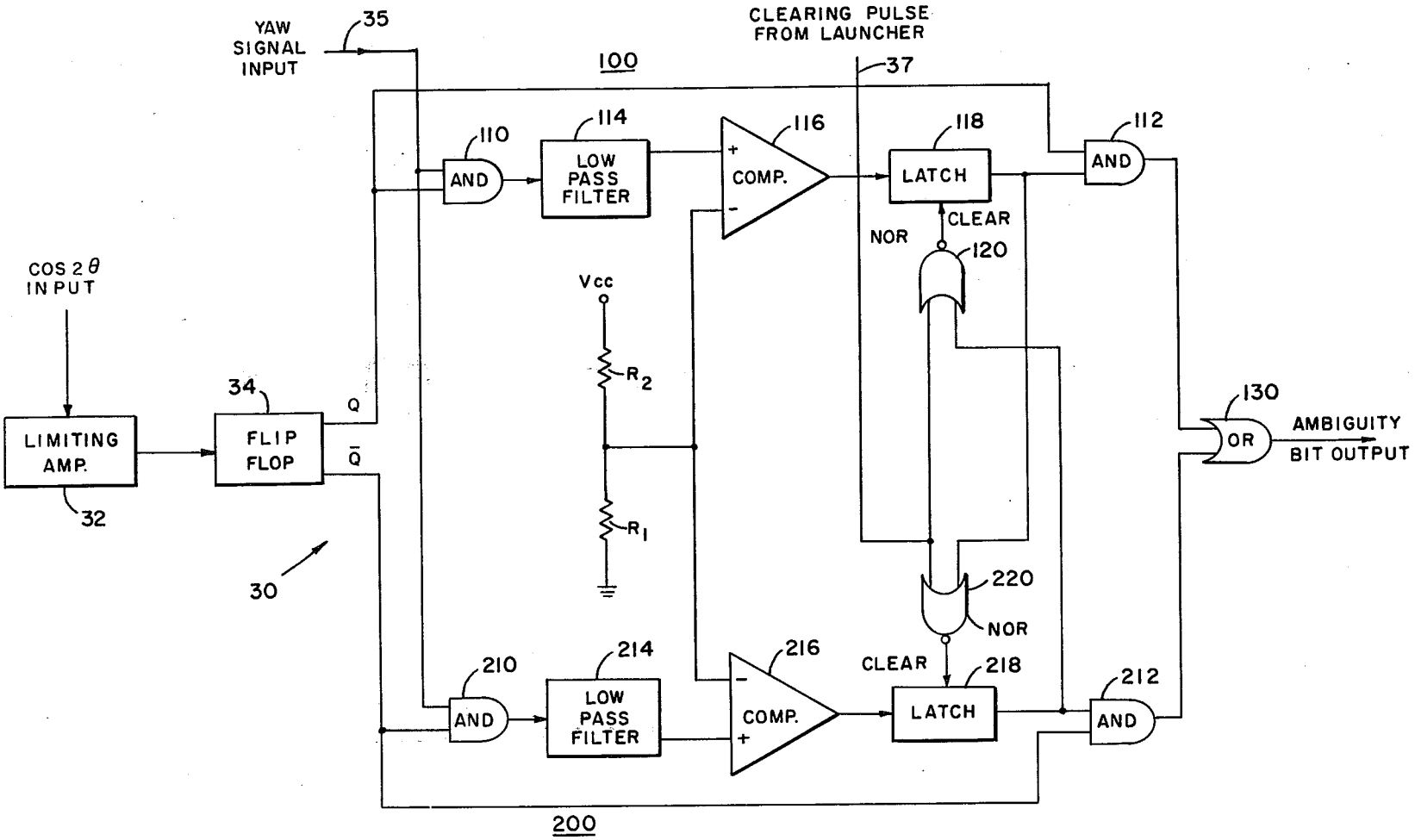
FIG. 3 is a block diagram of an ambiguity circuit.

This 180° ambiguity of the $\cos 2\theta$ output is resolved by ambiguity circuit 30. The purpose of this circuit is to generate a reference waveform at one-half the frequency of $\cos 2\theta$, whose phase will provide an indication to remove the 180° ambiguity. Referring to FIG. 3 and FIG.4, the $\cos 2\theta$ signal from filter 28 is applied to limiting amplifier 32 whose output is a square wave. This square wave is divided by 2 by flip-flop 34, providing Q and $\overline{Q}$ outputs 180° out of phase as indicated. Q and $\overline{Q}$ waveforms could be interchanged. Note that the Q and $\overline{Q}$ outputs switch on the negative transitions of the limiting amplifier output, or at $\theta = 45°$ and $\theta = 225°$ (FIG. 4). A positive value of Q (or $\overline{Q}$) is predetermined to indicate "right" and "down"; then "left" and "up" are indicated whenever the selected Q (or $\overline{Q}$) is low. Once the appropriate output (Q or $\overline{Q}$) is selected, the normal missile roll sequence will preserve this phase relationship and permit the selected Q or $\overline{Q}$ waveform to indicate thereafter the correct 180° phase of the ambiguious cos $2\theta$ waveform. The ambiguity resolution then simply requires that the correct Q or $\overline{Q}$ be selected as the proper polarity bit, which depends on the initial phases of Q and $\overline{Q}$ with respect to the true right-left (or updown) roll position that generated the cos $2\theta$ waveform.

One means of solving this ambiguity (selection of Q or $\overline{Q}$) is as follows. Assuming the missile is mounted in its launcher in a preferred roll orientation, $\theta = 0°$. Further assume that the missile is known to roll after launch, in the direction of increasing $\theta$, and that the optical attitude reference system will begin operating at some time after launch, when $\theta$ is predictably known to be between +45° and +90°. Since the actual angle lies between these limits at this time, the proper Q or $\overline{Q}$ output should be high. Whichever output is high will be selected, (this selection must be completed before $\theta$ = 225°) and becomes the 180° ambiguity bit. This bit may later change value if the missile continues to roll, but will still properly indicate the correct 180° phase of the ambiguious cos $2\theta$ waveform.

As shown in FIG. 3, the Q output of flip-flop 34 is coupled to a channel 100 of circuit 30 and the $\overline{Q}$ output is coupled to an identical channel 200. The Q output is coupled as an input to AND gates 110 and 112. A yaw signal input 35, indicative of angle $\psi$, FIG. 1, from a source (not shown) in the missile is coupled to AND gate 110. For attitude reference system 14A, this input 35 is a fixed positive voltage as previously stated, which will cause gate 110 to pass the Q signal to its output. Coupled in series between AND gate 110 and 112 is a low pass filter 114, a comparator 116 and a latching circuit 118. Comparator 116 is biased by a voltage $V_{cc}$ developed across a series resistance network R1 and R2. A NOR gate 120 has an input releasably coupled to receive a clearing pulse input 37 from the launching station (not shown) prior to launch, another input coupled to the latch output of channel 200 and an output coupled to latch 118. The output of latch 118 is further coupled as an input to the NOR gate of channel 200. The output of AND gate 112 is coupled as an input to an OR gate 130 which provides the ambiguity bit output. Similarly, channel 200 comprises AND gate 210 and 212, with filter 214, comparator 216, and latch 218 coupled in series therebetween. Nor gate 220 is similar to gate 120 and the output of AND gate 212 is coupled as an input to OR gate 130.

This circuit selects the Q or $\overline{Q}$ output, whichever is high after circuit initiation (for a sufficiently long time for low pass filter 114 to respond, typically one to ten milliseconds) and by the action of latch 118, permanently couples that Q (or $\overline{Q}$) output through OR gate 130 as the correct ambiguity bit, even though its value may subsequently change. The clearing pulse may be momentarily applied at input 37 (such as by manual application of a positive voltage) to clear both latches for circuit test purposes as well as initialization.

Thus the output OR gate 130 has an one of its inputs a low from the AND gate 112 or 212 which has as its input the latch with the low output, and the output OR gate has as its other input the input to the other AND gate 212 or 112 since that latch output is high. The OR gate then passes this single changing input (which is either Q or $\overline{Q}$, whichever is initially positive) to its output as the correct ambiguity bit. For the phases or waveforms shown in FIG. 4, selection of Q indicates missile roll angle between 45° and 225°, and $\overline{Q}$ the remaining 180° between 225° and 405°. Thus the 180° roll ambiguity has been eliminated. This information is used by the missile guidance system to properly control the missile as desired. This operation holds for a rolling missile where the ambiguity bit cycles appropriately with roll angle $\theta$ to indicate left versus right (FIG. 4). It also holds equally for a non-rolling missile where a steady state flip-flop output indicates the correct 180° position (left versus right) which is further defined by the cos $2\theta$ output to indicate static roll angle.

Figure 5:
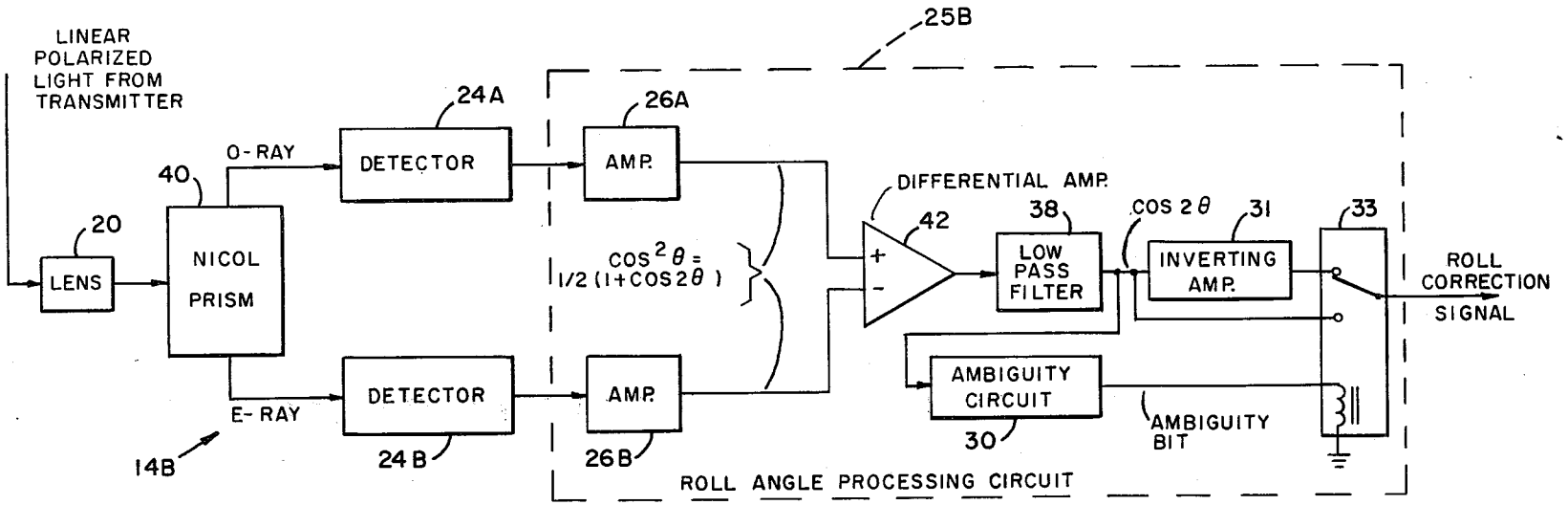
FIG. 5 is a block diagram of the light detector system for a roll stabilized missile.

FIG. 5 is an embodiment of the optical attitude reference system 14B which permits operation with a missile that is to be controlled at a fixed roll angle rather than allowed to roll. In optical attitude reference system 14B, the simple polarizer 22 is replaced with a Nicol, Wollaston, or Glan-Thompson prism 40, which has the property of separating incoming light into two perpendicularly polarized components, called the ordinary ray (O-ray) and the extraordinary ray (E-ray). When the prism is oriented so that these two planes of polarization in the output light are each 45° from the input light polarization, half the optical power will appear in each output polarization. If the prism is then rotated slightly, to output ray becoming more nearly parallel to the incoming light in polarization angle will increase the power, and the other ray will decrease. Power in the two rays is proportional to $\cos^2\theta$, and $\cos^2(\theta + 90°) = \sin^2\theta$, in a manner identical to single axis linear polarizers. The prism polarizer is disclosed in "Physics" by Halliday and Resnick, and published by John Wiley and Sons, 1967, Chapter 46.

These two output rays are collected by respective optical detectors 24A and 24B, producing a voltage, which is coupled to roll angle processing circuit 25B and is then amplified in amplifiers 26A and 26B. The two amplifier outputs are coupled to a differential amplifier 42, wherein subtraction produces a voltage whose magnitude is related to the amount of roll angle error, and whose polarity gives the direction of the roll error. The actual function is $\cos^2\theta - \sin^2\theta = \cos 2\theta$, where $\theta$ is the roll position of the roll stabilized missile. The output signal is then coupled through filter 38, with a portion of the signal coupled through ambiguity circuit 30.

Figure 6:
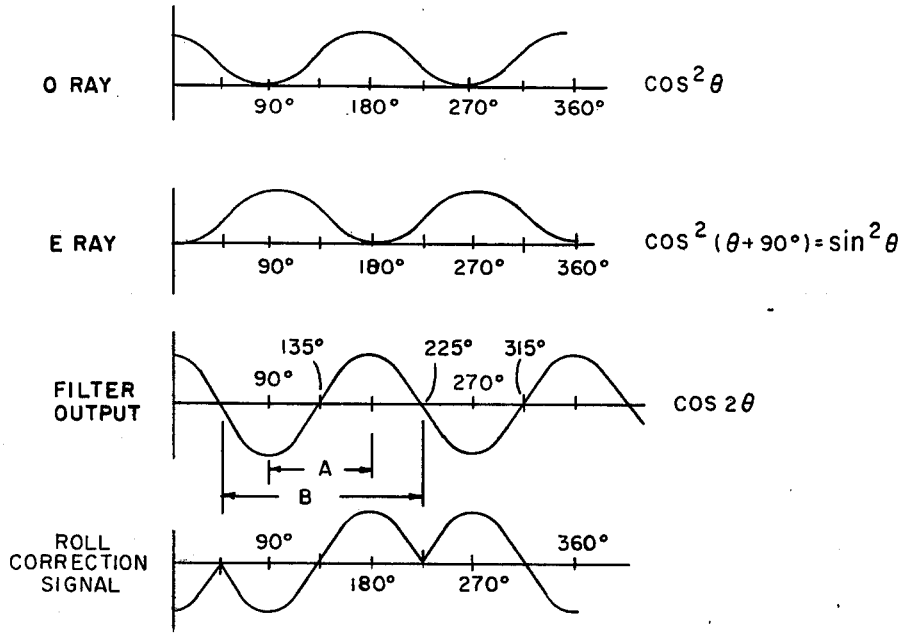
FIG. 6 is a waveshape diagram of the signals present in the circuits of FIG. 5.

The circuit could provide roll null at any of the four zero crossing angles as shown in FIG. 6 for the differential amplifier output (cos $2\theta$). However, selection of the polarity interface with the missile control system will restrict stable operation to only two of the roll angles (with the same slope of cos $2\theta$) for example 135° and 315° (positive slope), or 45° and 225° (negative slope). The control system must then maintain roll within ± 90° to remain stable. However, the ambiguity circuit 30 provides a signal to eliminate one of these two null conditions and provides a single null roll angle such as the 135° null of FIG. 6.

FIG. 6 shows the typical related waveshapes acted upon in the roll stabilized embodiment of FIG. 5. The amplitudes of the O-ray and the E-ray outputs of prism 40 are 180° out of phase. Subtraction of these two waveforms produces cos $2\theta$ (since $\cos^2\theta - \sin^2\theta = \cos 2\theta$). Where the missile is roll stabilized with respect to the 135° null point as shown, variation in the missile roll angle is sensed in amplifier 42 and coupled out as the signal null varies away from the zero value at $\theta = 135°$. The output voltage increases positively for roll angles greater than 135° and increases negatively for roll angles less than 135° over a range of ± 45° as shown as A.

The same signal polarity is obtained up to 90° either side of null as shown at B for variation in roll angle. Correct signal polarity is indicated at all angles with inclusion of the ambiguity bit from abiguity circuit 30.

FIG. 5 shows one method for implementing the ambiguity bit. The cos $2\theta$ waveform from filter 38 is coupled directly to a contact of a relay 33, and also through an inverting amplifier 31 to another contact of relay 33. The relay contacts normally provide the inverted signal ($-\cos 2\theta$) at the relay output. However, whenever the ambiguity bit from circuit 30 is high, the $+\cos 2\theta$ signal from filter 38 is provided at the relay output. The resulting output is the final roll correction signal, as shown in FIG. 6.

Figure 7:
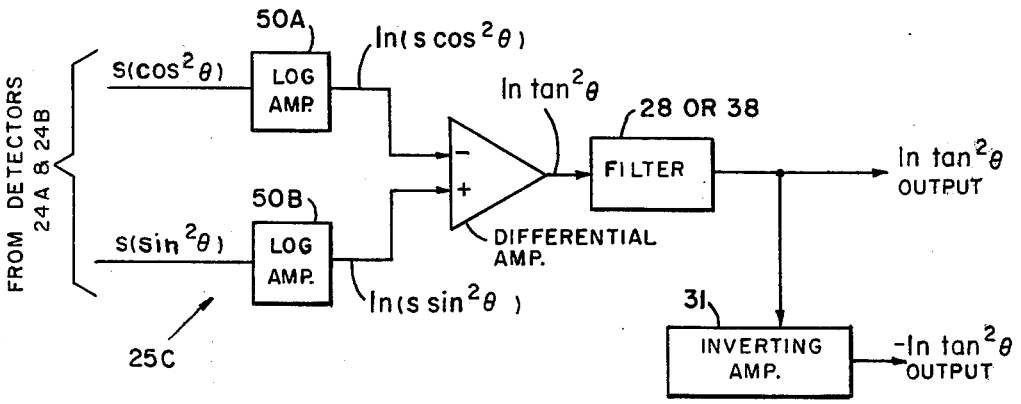
FIG. 7 is an embodiment of the roll angle processing circuitry which eliminate atmospheric amplitude modulation effects.

The embodiment of FIG. 7 permits a unique refinement to the roll angle processing circuit 25 to eliminate the effects of atmospheric amplitude modulation (scintillation) of the received signal. The sum of the power in the two polarized outputs from the Nicol prism of FIG. 4 is always equal to the total power received from the transmitter by the prism (except for transmission losses). Since scintillation consists of an amplitude modulation of the received power, it may be removed by division of the two signals, $S \sin^2\theta / S \cos^2\theta = \tan^2\theta$, which is free of the atmospheric amplitude modulation, S.

A simple means of accomplishing this is with the roll angle processing circuit 25C, shown in FIG. 7, wherein the amplifiers 26 are replaced with logarithmic amplifiers 50. The logarithmic amplifiers 50A and 50B permit the use of differential amplifier 42 to accomplish the division. The output of the differential amplifier 42 is $\ln S \sin^2\theta - \ln S \cos^2\theta = \ln \tan^2\theta$, where S is amplitude modulation of atmospheric scintillation. The voltage to angle relationship is no longer sinusoidal, but is still a usable signal for providing roll angle determination and correction. This feature is highly desirable for use in conditions where atmospheric scintillation is large. Therefore the implementation of this compensating circuit may be used for both the rolling missile and for the roll stabilized missile, with atmospheric scintillation being effectively removed, permitting utilization over long distances through turbulent atmosphere. The rolling or roll stabilized missile usage determine whether the filter is bandpass 28 or lowpass 38.

FIG. 4 shows the waveforms of ambiguity circuit 30 when provided with the cos $2\theta$ waveform of the roll circuits of FIGS. 2 and 5. If the roll circuit of FIG. 7 is used instead, the $\ln \tan^2\theta = 0$ whenever $\cos 2\theta = 0$, and further is always opposite in polarity. Thus if $-\ln \tan^2\theta$ is directly substituted for cos $2\theta$ in FIG. 4 (as the input to limiting amplifier 32), the limiting amplifier 32 output remains the same. Thus the ambiguity circuit 30 operates equally well with the $-\ln \tan^2\theta$ output of FIG. 7 provided by inverting amplifier 31, and could be used to selectively invert $\ln \tan^2\theta$ in a manner similar to FIG. 5, or may be used directly by the missile guidance system instead. When an optical beam is used for this roll angle determination, conventional tracking techniques may be added at little increase in complexity. The use of a two axis optical position sensing detector (such as the SC-10 detector produced by United Detector Technology) for one or both of the two detectors 24 in the receiver unit permits measurement of the missile body axis (pitch and yaw) with respect to the beam axis. Such an embodiment then produces from a single beam, and from established reference electronics on the missile, the missile roll angle, missile pitch angle, missile yaw angle, and freedom to modulate the laser beam (for example, high frequency pulse position encoding) to provide a communication channel from the ground station to the missile. This provides a secure communication link for missile guidance commands.

Figure 8:
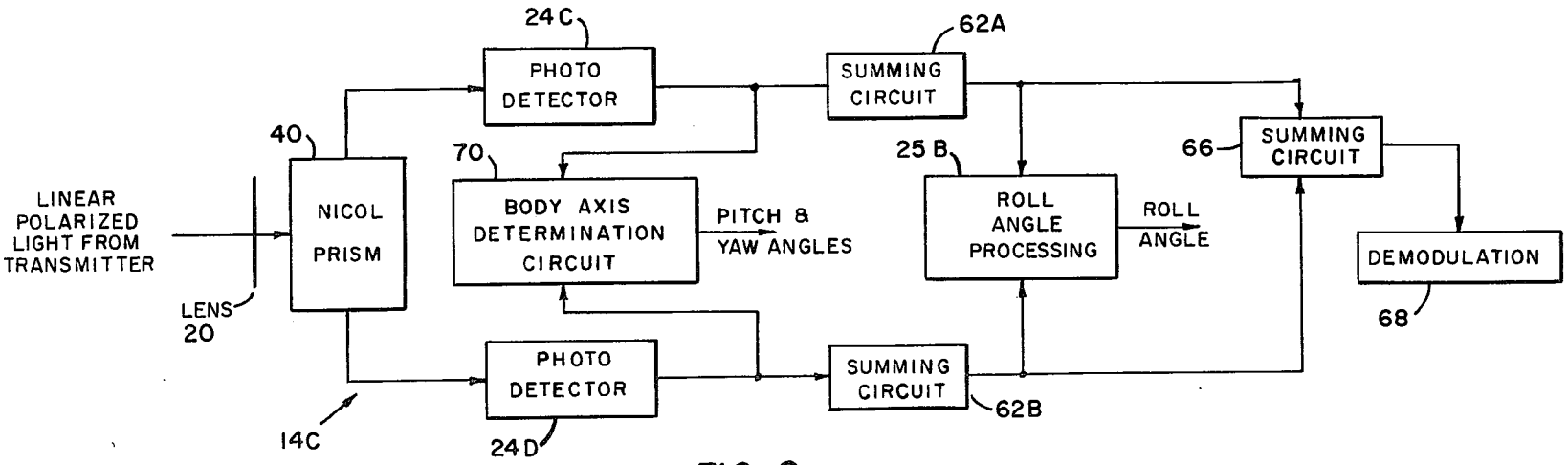
FIG. 8 is a simplified system embodiment wherein multiple output photodetector circuits permit measurement of missile pitch, yaw, and roll angle in the system.
Figure 9:
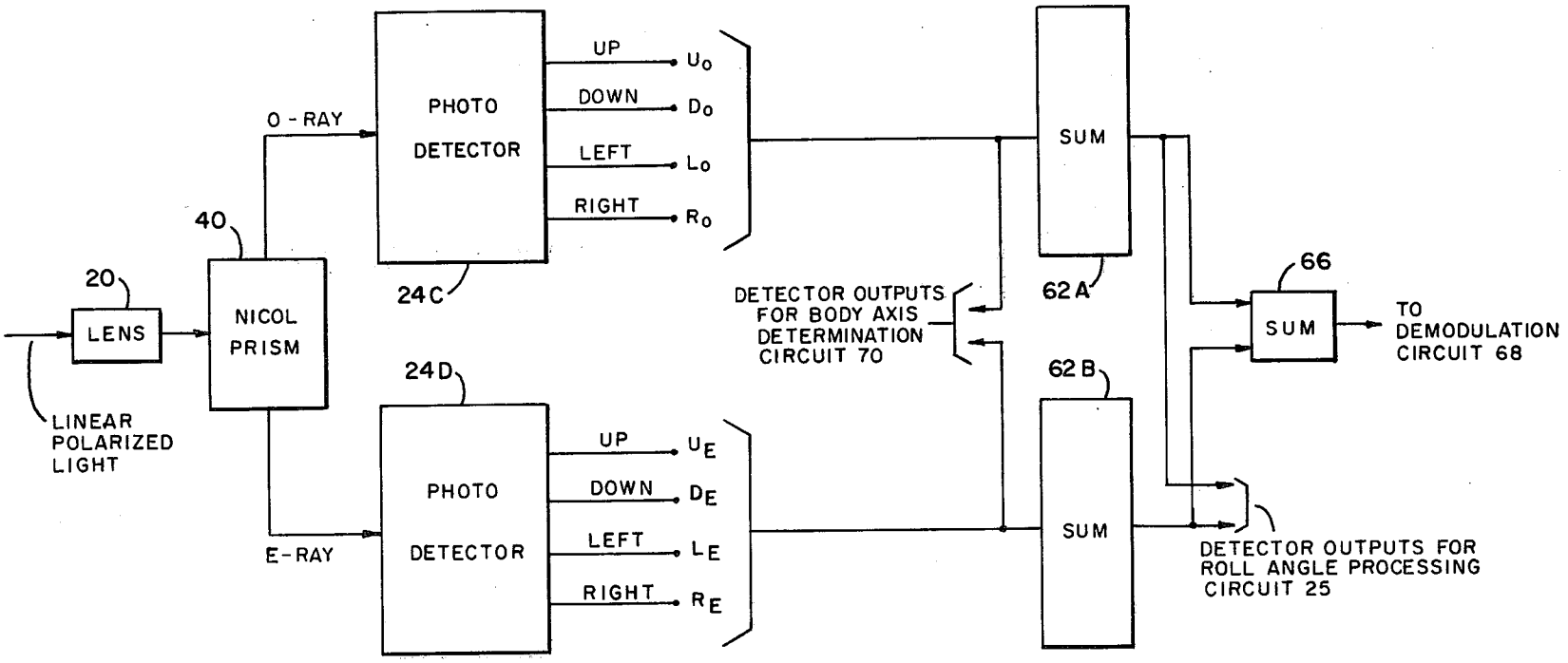
FIG. 9 is a more detailed description of the photodetector circuit of FIG. 8.
Figure 10:
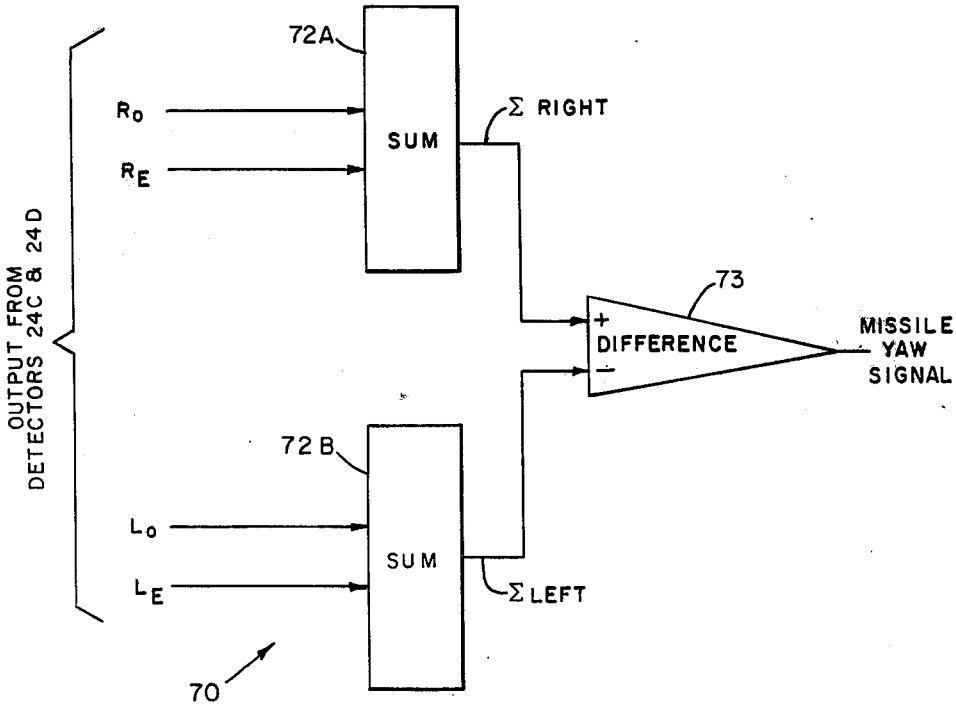
FIG. 10 is the body axis determination circuit of FIG. 8 for a typical yaw signal.

This preferred embodiment of the optical attitude reference system 14C is shown in FIGS. 8, 9, and 10. Each position sensing detector or photodetector 24C is a two axis, linear light position detector. Two sets of differential electrical output signals indicate the $x$ and the $y$ (pitch and yaw) position of an input light signal with respect to the axis defined by the detector center and lens axis.

FIGS. 8 and 9 disclose the O-ray and E-ray outputs from the prism 40 to be coupled to photodetectors 24C and 24D. Either the O-ray or the E-ray may be caused to be $\sin^2\theta$ or $\cos^2\theta$ by selection of the beam polarization reference angle with respect to the Nicol prism orientation. For purposes of illustration the O-ray = $\cos^2\theta$, and E-ray = $\sin^2\theta$. The four position sensing outputs from each detector 24C, 24D are coupled to respective summing networks 62A and 62B to provide the roll angle processing signals with outputs from summing circuits 62 being coupled as respective detector outputs to the roll angle processing circuitry 25. These sum outputs are further coupled to a summing circuit 66 for coupling to conventional demodulation circuitry 68 for obtaining any communication from the ground station. Obviously, where atmospheric scintillation is a problem the roll-angle processing circuit 25C (FIG. 7) may replace circuit 25B.

For body axis determination (pitch and yaw) selected outputs of detectors 24C are coupled to body axis circuit 70. As shown in FIG. 10, these inputs to circuit 70 are summed in respective summing networks 72A and 72B with the sum outputs being coupled to a difference detector 73 to obtain the magnitude and polarity of the signal. While FIG. 10 indicates yaw channel circuits, an identical pitch channel circuit is also used if two axis sensing is required. Output from the body axis and roll angle circuitry are then coupled to using circuitry for controlling or indicating the pitch, yaw and roll angle of the missile.

This body axis measurement also provides a means of resolving the roll angle ambiguity shortly after launch. The launch geometry may be configured with a transmitter offset (for example, 20 feet left of the launcher). This will provide a large signal in missile body axis measurement circuit 70 relative to the beam axis during the early portion of the flight. Since the direction of this angular offset is known the missile right/left ambiguity may be determined. Once determined, the normal roll sequence makes re-determination later in flight unnecessary, as the relative phase (cos $2\theta$ with respect to the flip-flop output waveform) will not change. Ambiguity determination is accomplished by the circuitry of FIG. 3, utilizing the measurement of missile yaw signal from FIG. 10; also shown as yaw signal input 35 in FIG. 3.

In selecting the correct ambiguity bit, the two AND gates 110 and 210 using Q or $\overline{Q}$ and the yaw signal input 35 from difference amplifier 73 of FIG. 10 as inputs each provide a high output only when both inputs are high. This occurs one-half the time for the gate with the in-phase waveforms (Q and yaw), and not at all for the 180° out of phase waveforms ($\overline{Q}$ and azimuth), as shown in FIG. 3. These outputs are low pass filtered to recover the D.C. value and are coupled to comparators which have initially low outputs (for low inputs) and which switch position when the filter output rises above a reference voltage established by the supply voltage $V_{cc}$ and the voltage divider formed by resistors R1 and R2. Only the comparator following the "in-phase" AND gate will switch, the positive transition setting the latch, which thereafter maintains its AND gate 112 or 212 enabled (high input) to pass the inphase signal through to the OR gate 130. As a precaution against noise or transients later firing the other latch, the enabled latch, through NOR gate (120 or 220), holds the unenabled latch cleared for the remainder of the flight. These two NOR gates are also provided a pulse input at missile launch to clear both latches initially either automatically or manually, such as an operator simply activating a switch. Most commercial latches clear on the logic low as used in this circuit.

Figure 11:
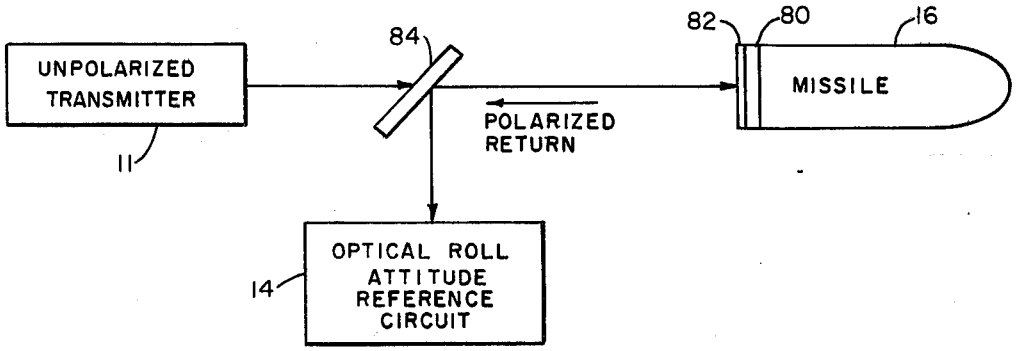
FIG. 11 is a block diagram of a ground station detector embodiment of the invention.

As shown in FIG. 11, the optical attitude reference circuit 14 is located with an unpolarized transmitter 11, and a retro-reflective prism 80 is placed on the missile 16 in lieu of the active circuits. A linearly polarizing film 82 over the retro-reflector allows the retro-reflector to direct only linearly polarized optical energy back toward the transmitter, which permits its reception by use of either a beam-splitter 84, or by simply a very close location of circuits 14 and transmitter 11 due to beam spreading of the retro-return.

The retro-reflected beam is polarized according to the angle of rotation of the polarizer on the missile. The polarization angle of the retro-reflected beam contains the roll angle information (imparted by the polarizing film on the retro), and the ground receiver polarizing angle is the vertical reference.

Operation of the earth based optical roll attitude reference circuit 14 of FIG. 11 is the same as for the missile mounted embodiments, except that the earth based receiver polarizer is the stationary reference and the plane of the polarization of the received beam is rotating. Identical circuits are used, except the roll ambiguity solution can only be accomplished by the initial method presented, that is, the application of a dc voltage at input 35 of circuit 30 indicative of predicted roll angle at circuit actuation time. This is because the missile yaw signal is unavailable to the electronics at the launch site.

Although particular embodiments of this invention have been illustrated, it is apparent that various modifications of the invention may be made by those skilled in the art without departing from the scope and spirit of the foregoing disclosure. Accordingly the scope of the invention should be limited only by the claims appended hereto.

We claim:

1. Apparatus for providing optical attitude reference for a missile comprising: transmitter means for directing optical energy from a fixed station toward said missile; optical detector means on said missile responsive to optical energy from said transmitter for providing electrical output signals; a prism disposed on said missile adjacent said optical detector means and between said optical detector and said transmitter, said prism having an ordinary ray output and an extraordinary ray output, said prism being disposed for polarizing optical energy from said transmitter prior to said energy being received by said optical detector; said optical detector means comprises first and second detectors disposed to receive said ordinary and extraordinary prism outputs respectively and provide an electronic output signal responsive thereto; first and second amplifiers disposed respectively to receive inputs from said first and second detectors to provide output signals responsive thereto and a differential amplifier coupled to receive said first and second amplifier output signals for providing an output signal; filter means disposed to receive the differential amplifier output for providing an output signal for coupling to indicator or load circuitry; and ambiguity means coupled to the output of said filter means for selectively providing a predetermined output signal; said ambiguity means comprising a limiting amplifier coupled to the output of said differential amplifier, a flip-flop coupled to the output of said limiting amplifier for providing a square wave frequency output at one-half the frequency output of said limiting amplifier, said flip-flop having both an inverted and a non-inverted output; first and second signal channels having inputs coupled respectively to said flip-flop outputs; an OR gate having first and second inputs and an output, said OR gate being coupled to receive output signals from said first and second channels and provide an output signal when said predetermined flip-flop output is present on either channel; each of said channels comprising, in series, a first AND gate, a low pass filter, a comparator, a latching circuit, and a second AND gate, said first AND gate being coupled to respective outputs of said flip-flop and said second AND gate being coupled to provide an input to said OR gate; each of said first AND gates being adapted to receive a reference signal input from an external source; and inhibit means coupled to each of said latching circuits for preventing simultaneous operation of said latches.

2. An optical attitude reference apparatus as set forth in claim 1 wherein said first and second amplifiers are logarithmetic amplifiers.

3. Apparatus for providing optical attitude reference for a missile comprising: transmitter means for directing optical energy from a fixed station toward said missile; optical detector means on said missile responsive to optical energy from said transmitter for providing electrical output signals; polarizing means on said missile disposed adjacent said optical detector means and between said optical detector and said transmitter, said polarizing means being disposed for polarizing optical energy from said transmitter prior to said energy being received by said optical detector; amplifier means responsive to the output of said detector; and filter means disposed to receive said amplifier output for providing an output signal for coupling to indicator or load circuitry; and wherein said polarizer is a Nicol prism; said optical detector means comprises first and second photodetectors, each having four outputs for indicating two axis light position on the surface of the respective detectors; first and second summing circuits coupled to respective first and second photodetector outputs for summing said outputs; and outputs from said first and second summing circuits being coupled to said amplifier means for providing said indicator output signal indicative of missile roll angle.

4. A optical attitude reference apparatus as set forth in claim 3 and further comprising a third summing network having inputs coupled to receive the outputs of said first and second summing networks for providing a total sum output indicative of the composite transmitter signal impinging on said optical detector.

5. An optical attitude reference apparatus as set forth in claim 4 and further comprising a body axis determination circuit comprising fourth and fifth summing circuits and a first difference circuit, said fourth and fifth summing circuits each having first and second inputs coupled respectively to first and second of said four outputs of said photodetectors respectively, and having respective outputs coupled as inputs to said first difference circuit; said difference circuit providing an output indicative of light impinging on said photodetectors representing a missile attitude reference signal output.

6. Apparatus for providing optical attitude reference for a missile comprising: transmitter means for directing optical energy from a fixed station toward said missile; optical detector means on said missile responsive to optical energy from said transmitter for providing electrical output signals; polarizing means on said missile disposed adjacent said optical detector means and between said optical detector and said transmitter, said polarizing means being adapted for polarizing optical energy from said transmitter prior to said energy being received by said optical detector; amplifier means responsive to the output of said detector; and filter means disposed to receive said amplifier output for providing an output signal for coupling to indicator or load circuitry; and ambiguity means coupled to the output of said filter means for selectively providing a predetermined output signal; said ambiguity means comprising a limiting amplifier coupled to the output of said filter means for providing a square wave output in response to the input thereto; a flip-flop circuit coupled to the output of said limiting amplifier for providing a square wave frequency output at one-half the frequency output of said limiting amplifier, said flip-flop having both an inverted and non-inverted output square wave output frequency; first and second signal channels having inputs coupled respectively to said flip-flop outputs; an OR gate having first and second inputs and an output, said OR gate being coupled to receive output signals from said first and second channels and provide an output signal when said predetermined flip-flop output is present on either channel, and wherein each of said channels comprise, in series, a first AND gate, a low-pass filter, a comparator, a latching circuit, and a second AND gate, said first AND gate being coupled to an output of said flip-flop and said second AND gate being coupled to provide an input to said OR gate; and each of said first AND gates being adapted for coupling to receive a reference signal input from an external source.

7. An optical attitude reference apparatus as set forth in claim 6 wherein each channel of said ambiguity circuit further comprises a NOR gate having an output coupled to said latching circuit and an input coupled to receive an output from the other channel latching circuit for allowing operation of only one of said latches.

* * * * *